US011691157B2

(12) United States Patent
Sabol et al.

(10) Patent No.: US 11,691,157 B2
(45) Date of Patent: Jul. 4, 2023

(54) ADAPTIVE ARCHITECTURE SOLIDS DIVERTER AND COMMINUTOR

(71) Applicant: SULZER MANAGEMENT AG, Winterthur (CH)

(72) Inventors: Rob Sabol, Aliso Viejo, CA (US); Corey Glauberman, Tustin, CA (US); Brian Bowling, San Dimas, CA (US); Todd Nydam, Newport Beach, CA (US)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/465,347

(22) PCT Filed: Dec. 20, 2018

(86) PCT No.: PCT/US2018/066732

§ 371 (c)(1),
(2) Date: May 30, 2019

(87) PCT Pub. No.: WO2019/126456

PCT Pub. Date: Jun. 27, 2019

(65) Prior Publication Data

US 2021/0094040 A1 Apr. 1, 2021

Related U.S. Application Data

(60) Provisional application No. 62/608,884, filed on Dec. 21, 2017.

(51) Int. Cl.
*B02C 18/00* (2006.01)
*B02C 18/14* (2006.01)
(Continued)

(52) U.S. Cl.
CPC ..... *B02C 18/0092* (2013.01); *B02C 18/142* (2013.01); *B02C 18/16* (2013.01);
(Continued)

(58) Field of Classification Search
CPC . B02C 18/0092; B02C 18/0084; B02C 18/16; B02C 18/142; B02C 2201/06;
(Continued)

(56) References Cited

U.S. PATENT DOCUMENTS 2,142,480 A * 1/1939 Satzinger ..... B02C 18/301 241/82.2
2,227,090 A * 12/1940 Hughes ..... B02C 13/26 209/404
(Continued)

FOREIGN PATENT DOCUMENTS

CN 1940194 A * 4/2007
CN 1940194 A 4/2007
(Continued)

OTHER PUBLICATIONS

KR 101406699 Machine Translation, 2011 (Year: 2011).*
(Continued)

*Primary Examiner* — Shelley M Self
*Assistant Examiner* — Smith Oberto Bapthelus
(74) *Attorney, Agent, or Firm* — Sughrue Mion, PLLC

(57) ABSTRACT

A system for comminuting solid waste material including a shredding device disposed within the casing and comprising parallel first and second shredding stacks that include first and second parallel shafts rotatably mounted between an upper shredding device housing and a lower shredding device housing and a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device. The upper shredding device
(Continued)

housing and the lower screening device housing are separate members from the upper screening drum housing and the lower screening drum housing to permit interchangeability of different sizes of these components to meet system needs.

11 Claims, 8 Drawing Sheets

(51) Int. Cl.

| | |
|---|---|
| ***B02C 18/16*** | (2006.01) |
| ***B02C 23/10*** | (2006.01) |
| ***B02C 23/16*** | (2006.01) |
| ***B02C 23/36*** | (2006.01) |
| ***B02C 23/38*** | (2006.01) |

(52) U.S. Cl.
CPC ..... *B02C 23/10* (2013.01); *B02C 23/16* (2013.01); *B02C 23/36* (2013.01); *B02C 23/38* (2013.01)

(58) Field of Classification Search
CPC ... B02C 2201/063; B02C 23/36; B02C 23/16; B02C 23/10
USPC ..... 241/74, 46.06
See application file for complete search history.

(56) References Cited

U.S. PATENT DOCUMENTS

| | | | | |
|---|---|---|---|---|
| 4,919,346 | A | 4/1990 | Chambers, Sr. | |
| 5,320,286 | A * | 6/1994 | Chambers, Sr. | B07B 1/10 241/46.02 |
| 5,505,388 | A | 4/1996 | Chambers et al. | |
| 5,833,152 | A | 11/1998 | Galanty | |
| 6,176,443 | B1 * | 1/2001 | Boyd | B02C 18/0092 241/46.02 |
| 2011/0084154 | A1 * | 4/2011 | Amburgey | B02C 18/0092 241/15 |

FOREIGN PATENT DOCUMENTS

| | | | | |
|---|---|---|---|---|
| KR | 10-2009-0014046 | A | 2/2009 | |
| KR | 101406699 | B1 * | 6/2014 | |
| KR | 101406699 | B1 | 6/2014 | |
| WO | WO-2011044461 | A * | 4/2011 | B02C 18/0092 |

OTHER PUBLICATIONS

CN1940194A Machine Translation, 2007 (Year: 2007).*
Written Opinion for PCT/US2018/66732, dated Apr. 15, 2019.
International Search Report for PCT/US2018/66732, dated Apr. 15, 2019.

* cited by examiner

ADAPTIVE ARCHITECTURE SOLIDS DIVERTER AND COMMINUTOR

CROSS-REFERENCE TO RELATED APPLICATIONS

This Application is a National Stage of Application No. PCT/US2018/066732 filed Dec. 20, 2018, claiming priority based on U.S. Provisional Patent Application No. 62/608,884 filed on Dec. 21, 2017 in the U.S. Patent Trademark Office, the disclosure of which is incorporated herein in its entirety by reference.

BACKGROUND OF THE INVENTION

Pump stations are required in municipal wastewater collection systems where terrain does not allow for strictly gravity flow of sewage to a treatment facility. Sewage is typically comprised of water and soluble organics, including human waste, however, it may also contain non-soluble items. Examples of non-soluble items include: rags, shoes, articles of clothing, condoms, chunks of asphalt, bits of wood, money, wipes, rocks and many other items that are often flushed down the toilet or washed down the drain by industry and the general public. While lift station pumps are typically able to handle the soluble organics, blockages may occur when non-soluble materials are too large to pass through pump orifices. This behavior is often referred to as pump "ragging". Pump de-ragging is a costly, labor-intensive and hazardous process, and when those costs become significant, municipalities tend to employ either solids removal or solids reduction equipment to ensure the pump operates efficiently and without disruption.

In the wastewater solids reduction arena, twin-shafted shredders are common, however, hydraulic capacity limitations of the basic two-shaft configuration have resulted in the implementation of supplemental solids diverter technologies that aim to pass liquid and soluble organics, while classifying out and directing non-soluble items to the shredder mechanism. There are several incarnations of the solids diverter, including: vertically-oriented screen belts; vertical-axis rotating screen drums; stacks of interlaced rotating disks; mechanically-raked horizontal bar screens, and; even fixed perforated plate screens. Arguably, the most common solids diverter technology is based on the rotating screen drum. In this design, the twin-shafted shredder 10 (FIG. 1) is flanked by one or more cylindrical screen drums 20. While the cutter stack is operating, the screen drum(s) rotate in such a manner as to transport any solids collected on the face of the cylindrical screen to the cutter stack for particle size reduction.

In order to support both the twin-shafted cutter stack and the rotating screen drum(s), the bearings/seals at the top and bottom of the rotating component shafts are typically mounted in top and bottom end housings 30. These end housings are typically once piece castings or welded metal fabrications with machined pockets to hold the bearings. Using this design philosophy, the manufacturer can fix the placement of each drum relative to the cutter stack 40 (FIG. 2), close enough to minimize the bypass of material through the resulting gap 50, but not so close as to allow the cutters to damage the drum should the cutter stack shafts deflect while shredding tough objects. On the side of the drum opposite the cutter stack 60 (FIG. 3), a fixed baffle or side rail 70 is used to close the gap between the outside of the machine/channel wall 80 and the screen drum. This side rail provides a connection feature 90 between the machine and the mounting frame 100, inhibits bypass of flow around the screen drum 20, and directs flow to the drum. The side rail is also fitted with a sealing element 110 (eg. plastic strip or brush) making line contact with the drum fixed at the most upstream point 120 on the drum surface.

Unfortunately, there are negatives to the fixed nature of the contemporary philosophy: (1) As machine capacities increase, systems become bulky and difficult to manage; extracting the equipment from channels and wet wells becomes cumbersome. For any given drum diameter, the location of the cutter stack relative to the drum is fixed, thereby limiting the minimum allowable channel width for installation. Changing of one or more components requires a complete teardown of the machine, and failure of a given component tends to bleed through the entire unit. (2) Pump station requirements can vary over time due to population growth. The composition of the waste stream may shift, due to changes in industry, as well as the addition of institutions to the collection system that can produce higher volumes and tougher solids. Fixed configuration machines do not allow for changes of the screen drum or comminutor elements without changing out the entire machine to one of another configuration. (3) While the screen drum sealing element is adjustable to minimize material bypass around the front of the drum, the location of the sealing element around face of the drum is fixed. This makes the design inflexible to adjustments that may increase the capacity of a particular screen drum/cutter stack configuration, resulting in a trade-off between flow capacity and capture/shredding of solids. (4) High capture is not necessarily expected with high flow applications, however, it is reasonable to expect high capture with comparatively low flow applications. With current screen drum technologies, the clearance 50 (FIG. 3) between the drum and the cutter stack is fixed. This limitation takes away the possibility of adjusting or tuning the clearance, and thusly the degree of capture, based on the unique requirements of any given application. (5) When the cutter stack is worn out, the entire machine must be removed from the channel for repair. In fact, the wetted part of the machine may need to be sent to a repair depot for refurbishment if the customer does not want to complete the repair themselves. This requirement inflates the repair cost of the machine as: (i) parts of the machine other than the cutter stack may still be suitable for continued service, and; (ii) the cost of shipping the machine may be significant.

In summary, contemporary rotating screen drum twin-shafted grinders may be bulky, inflexible devices that are not adaptable to changes in application capacity requirements without being oversized at the outset. In addition, these machines cannot be tuned to specific application requirements without disassembling and re-configuring, or replacing, the entire unit. Even then, some adjustments are impossible without redesigning and manufacturing components, like end housings and side rails to offer different characteristics. The same applies to repair of the unit, as the cutter stack and drum(s) are housed in common end housings, which tend to result in higher than necessary machine repair costs.

SUMMARY OF THE INVENTION

Aspects of the application related to a system for comminuting solid waste material that includes a casing defining a comminution chamber having two side walls and being open on opposite sides thereof for permitting the flow of liquid therethrough bearing solid waste material and being adapted for connection in a solid waste disposal line (i.e., open or closed channels). Also included is a shredding device disposed within the casing and comprising parallel first and second shredding stacks that include first and second parallel shafts rotatably mounted between an upper shredding device housing and a lower screening device housing, each of the first and second parallel shafts including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members. The system further includes a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device. The upper shredding device housing and the lower shredding device housing are separate members from the upper screening drum housing and the lower screening drum housing to permit interchangeability and size modifications to meet system needs.

According to another aspect, the shredding device and the rotating screening drum are configured to be positioned in the comminution chamber independent of one another. The system may further include a sealing element disposed between a wall of the casing adjacent to the rotating screening drum to form a seal between the rotating screening drum and the wall. The sealing element may contact the drum on at a position that ranges from a position between an axis of the rotating screening drum and a point on the wall in a direction perpendicular to the flow in the comminution chamber, to a position that is on the leading edge of the rotating screening drum.

According to another aspect, the shredding device is disposed adjacent to the rotating screening drum and separated by a predetermined minimum gap. The position of the minimum gap is located within a range from a point adjacent to a rotational axis of the rotating screening drum along a line perpendicular to a direction of flow through the comminution chamber, to a position on the most downstream position of the rotating screening drum.

According to another aspect, the rotating screening drum is formed using perforations to permit fluid to flow therethrough, and the size of the perforations vary along the surface of the rotating screening drum along a vertical direction. The perforations may be smaller at a bottom of the rotating screening drum than at a top of the rotating screening drum.

According to another aspect, the system may include an interconnecting frame that connects the shredding device and the rotating screen to at least one wall of the two side walls. The interconnecting frame may include an adjusting mechanism to adjust the position of the shredding device with respect to the wall or the rotating screen device. Additionally, the interconnecting frame may have a seal portion extending between the wall and the shredding device to prevent flow from passing between the wall and the shredding device. The interconnecting frame may also include an adjusting mechanism to adjust the position of the rotating screen device with respect to the wall or the shredding device. The adjustment mechanism may be adjacent one of the wall or the shredding device. The adjustment mechanism may comprise pins or stops to position the shredding device with respect to the rotating screening device to maintain a predetermined minimum gap between the shredding device and the rotating screening device.

According to another aspect, the system may include key disposed between the upper shredding device housing and the upper screening device housing and a corresponding one of the lower screening drum housing and the lower screening drum housing to control a relative position between the shredding device and the rotating screening device.

According to another aspect, the system may comprise a rotating screening drum formed using perforations to permit fluid to flow therethrough, and the size of the perforations vary along the surface of the rotating screening drum along a vertical direction. The perforations may be smaller at a bottom of the rotating screening drum than at a top of the rotating screening drum. While the perforations may be larger at the top of the of the rotating screening drum and smaller at the bottom facilitating increased capacity at higher flow periods, they may also be larger at the bottom of the rotating screening drum and smaller at the top to provide greater capture of smaller floating debris in the waste stream.

According to other aspects, with reference to FIG. 4, one preferred embodiment of the adaptive architecture solids diverter and comminutor consists of the following elements: (i) a two-shafted rotating cutter stack with interlaced cutters and spacers 200; (ii) shredder top end housing with bearings, seals, transfer gear set and cover 210; (iii) shredder bottom end housing with bearings, seals and cover 220; (iv) shredder drive mechanism 230; (v) vertically-aligned rotating screen drum 240; (vi) screen drum top end housing with bearing, seal, shroud and shroud cover 250; (vii) screen drum bottom end housing with bearing, seal, cover and shroud 260; (viii) screen drum channel seal, flow baffle and drum brush 270; (ix) screen drum drive mechanism 280; (x) grinder/screen drum interconnect frame 290, and; (xi) grinder/screen drum mounting frames 300 for connection to civil works 305. The benefits of the design can be described in five categories: modularity, adaptability, adjustability, connectivity and serviceability.

Modularity

The working elements of the shredder are separated into two main devices: the twin-shafted shredder 310 and the solids diverter 320. This separation has key benefits: (i) each device may be handled or manipulated individually, and; (ii) the machine may be configured with the drum element on the left of the shredder (FIG. 5), or with the drum element on the right of the shredder, to optimize flow and material capture behavior.

Adaptability

Connecting separate screen drum 320 and shredder elements 310 to one another allows either element to be detached and exchanged. Over time, the application may require higher capacity, so the solids diverter 320 (FIG. 6) may be decreased or increased in diameter, or the screen drum perforations may be increased or decreased in diameter. Different perforation diameters may even be included in the same screen drum 240 (FIG. 7). Decreasing the screen drum diameter may also be desirable as population requirements decrease requiring decreased capacity of the system and a desire to use more of the provided cutter stack of the grinder. It may also be beneficial to change the shredder 310 (FIG. 8) to one with different shredding characteristics, including cutter thickness, tooth count, tooth profile and/or torque capability. In addition to the benefit of mixing and matching screen drums and shredders, having separate elements will allow variation in the positioning of the cutter stack 310 (FIG. 9) relative to the drum 320. By tucking the cutter stack in behind the drum, a larger diameter drum may be employed, thereby increasing the capacity of the machine for a given channel width.

Adjustability

The hydraulic capacity of a machine is a function of the flow characteristics of the application and the open area of the machine. While there may be limitations to the size of drum element that may fit into a given channel, or the placement of the cutter stack relative to the drum element, machine capacity may also be influenced by altering the location of the sealing element 330 (FIG. 10) around the face of the drum. By moving the sealing element away from the cutter stack 310, the available open area of the drum may be increased. The location the sealing element contacts the drum, in turn affecting the shape of the flow baffle 270, may be moved around the face of the drum until the point of diminishing returns is found. This point is reached when the open area on the backside of the drum starts to become smaller than the open area on the front side of the drum. Thus, by altering the location of the drum sealing element, the capacity of a given drum/cutter stack configuration may be increased by as much as 60%. The trade-off is that altering the location of the drum sealing element can have a negative effect. At the 6 o'clock position 340, virtually all solids are positively directed toward the cutter stack. However, as the sealing element is moved towards the 9 o'clock position 350, some portion of the solids, namely the more buoyant items, may tend to get caught up in eddy currents ahead of the flow baffle and the drum without positive transport to the cutter stack.

Connectivity

By incorporating a philosophy of modularity, it became necessary to address the problem of maintaining appropriate clearance 50 (FIG. 11) between the drum 320 and the cutter stack 310. There are multiple methods of maintaining this clearance. In the preferred embodiment, the drum module 320 and the cutter stack module 310 are fastened to an interconnecting frame 290. This frame incorporates an adjustment mechanism 360 (FIG. 12) that may be operated from the side of the shredder opposite the drum module 320 (FIG. 13). In another embodiment, the adjustment mechanism may be operated from the side of the shredder closest to the drum 320 (FIG. 14). Furthermore, by altering the configuration of the interconnecting frame 290, it is possible to tuck the cutter stack in behind the drum, or expose it to more of the flow (FIG. 9). This can affect both capacity and capture effectiveness of the machine.

In another embodiment, the relative positions of the grinder module and drum module may be controlled using stops or locating pins 370 (FIG. 15).

In a further embodiment, the relative positions of the grinder module and drum module may be controlled using upper and lower key elements 380 (FIG. 16). The keys may be shaped to place the cutter stack substantially in the flow path, or tuck it in behind the drum. The dimensions of the keys may be used to vary the gap between the drum and the cutter stack: increasing the gap to increase capacity and decreasing the gap to increase solids capture and shredding effectiveness.

Serviceability

Modularity of the system significantly benefits serviceability of the equipment. The configuration allows the shredder module to be detached from the system and refurbished individually. Should the screen drum become damaged, the drum module may be repaired or exchanged without affecting the shredder module. By basing the design on a single drum, the failure point of a second drum is eliminated. Furthermore, the customer may stock replacement cutter stack and screen drum modules without having to maintain a complete spare unit in the warehouse.

Separating the screen drum into its own module facilitates the use of alternate materials for the drum housings. While the housings may be machined from castings, sheet metal fabrications or plastics may also be used to create the shrouds necessary to control the flow of sewage to the drum and cutter stack. Use of these alternate materials can result in a weight savings, which ultimately makes the equipment easier to handle and translates into savings in shipping costs.

Thusly, by incorporating modularity into the machine design, it becomes possible to pair a variety of screen drums with each shredder module. This allows the system to be adapted to changes in application flow capacity requirements without having to change out the entire machine. Conversely, for a given screen drum, it becomes possible to change out the shredder module in order to adapt to changes in shredding requirements.

BRIEF DESCRIPTION OF THE DRAWINGS

The above and other features and aspects of the present application will become more apparent by describing non-limiting exemplary embodiments thereof with reference to the attached drawings in which.

DETAILED DESCRIPTION OF THE EXEMPLARY EMBODIMENTS

Figure 1:
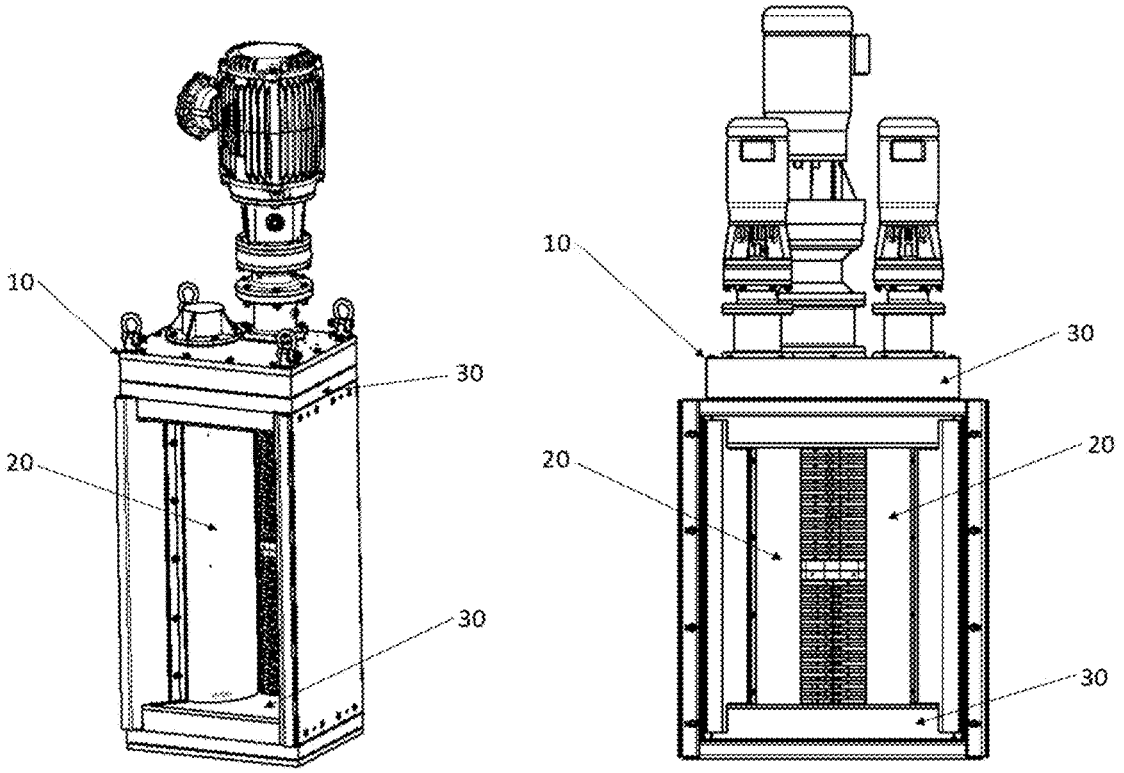
FIG. 1 Prior Art
FIG. 1 presents embodiments of a conventional screen drum comminutor with one and two rotating drums.
Figure 2:
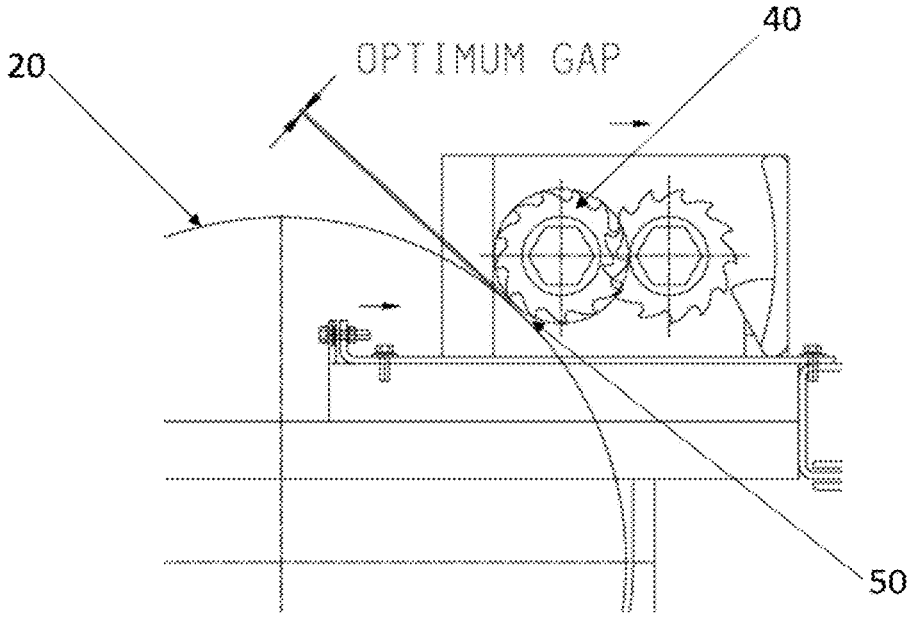
FIG. 2 Prior Art
FIG. 2 is a detail section showing the gap or clearance between the drum and the cutter stack.
Figure 3:
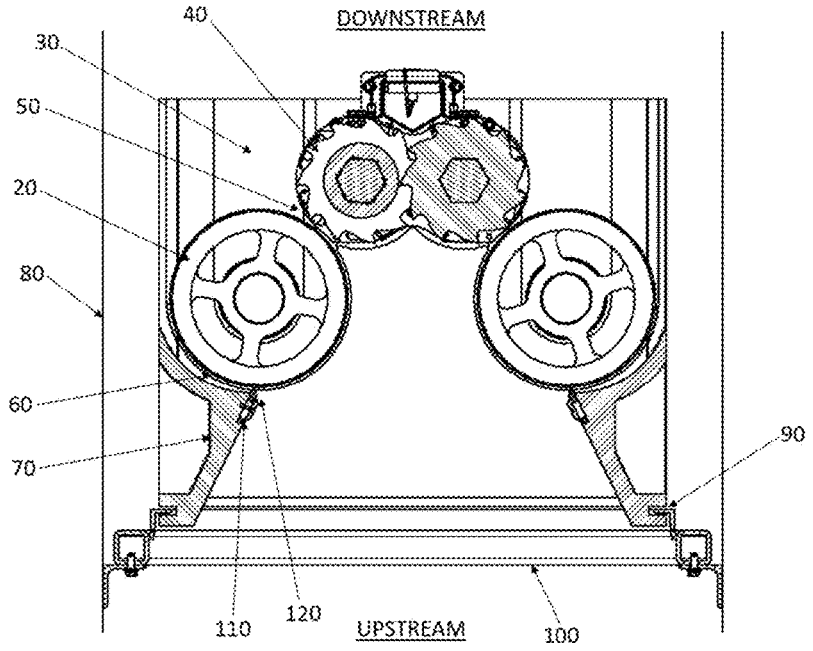
FIG. 3 Prior Art
FIG. 3 is a section view highlighting the drum sealing element and mounting frame connection points.
Figure 4:
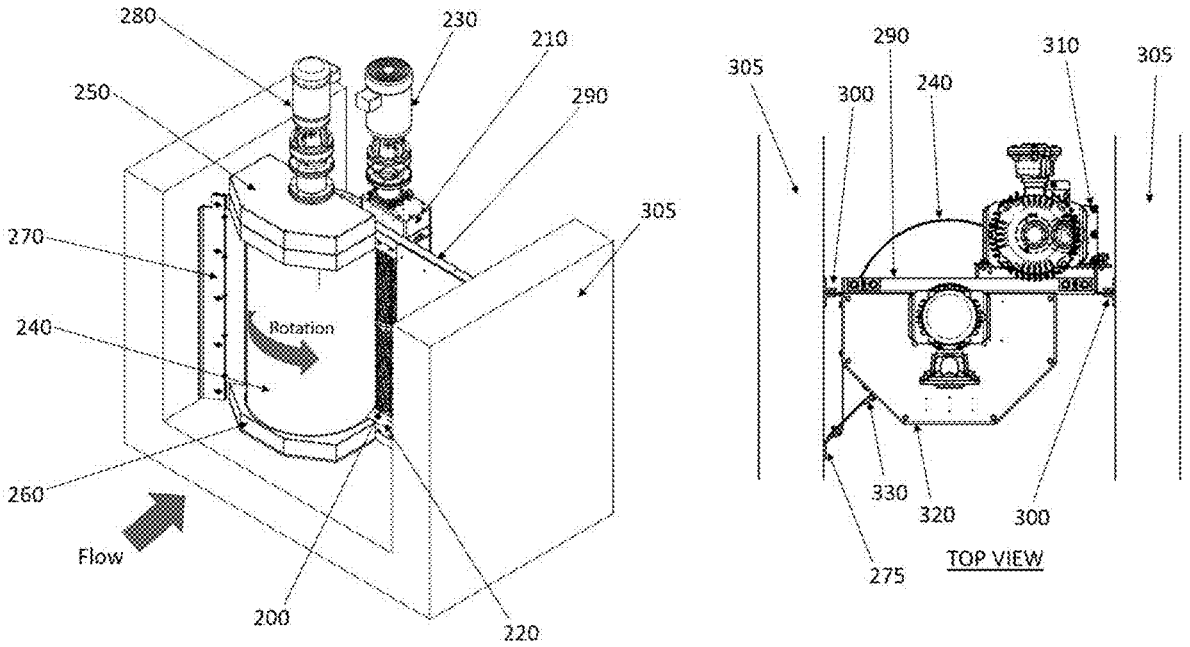
FIG. 4 is an isometric view of the preferred embodiment of the invention.

According to exemplary embodiments described herein, as is generally shown in FIG. 4, the adaptive architecture solids diverter and comminutor consists of the following elements: (i) a two-shafted rotating cutter stack with interlaced cutters and spacers 200; (ii) shredder top end housing with bearings, seals, transfer gear set and cover 210; (iii) shredder bottom end housing with bearings, seals and cover 220; (iv) shredder drive mechanism 230; (v) vertically-aligned rotating screen drum 240; (vi) screen drum top end housing with bearing, seal, shroud and shroud cover 250; (vii) screen drum bottom end housing with bearing, seal, cover and shroud 260; (viii) screen drum flow baffle 270, channel seal 275, and seal element 330; (ix) screen drum drive mechanism 280; (x) shredder/screen drum interconnect frame 290, and; (xi) shredder/screen drum mounting frame(s) 300 for connection to civil works 305.

The adaptive architecture solids diverter and comminutor are mounted vertically with the drives facing upward and positioned in a mounting frame, in turn fastened in an open channel, or on an internal wall of a wet well.

The two-shafted shredder 310 consists of two vertical stacks of interlaced rotary cutters 200 and spacers mounted on adjacent shafts supported by bearings retained in end housings 210, 220 at the top and bottom of the shafts. To mitigate the effects of liquid ingress to the bearings, shaft seals are fitted between the shafts and end housings on the wet or process side of the bearings. Counter-rotation of the shafts is accomplished using a pair of intermeshed, transfer gears mounted on like ends of the shafts. The top and bottom end housings are enclosed by covers to maintain a dry side to the shaft support bearings. Of the two shafts, one is the driving shaft and one is the driven shaft. The top end of the driving shaft protrudes through the cover on the top end housing 210. The protruding end of the shaft is coupled to a rotational drive mechanism 230 that may be electro-mechanical, hydro-mechanical or other. Together, these elements form what may be called the shredder module or shredder. In operation, the cutter stacks counter-rotate to form a nip on the upstream side of the shredder into which solids may be caught and shredded.

Figure 5:
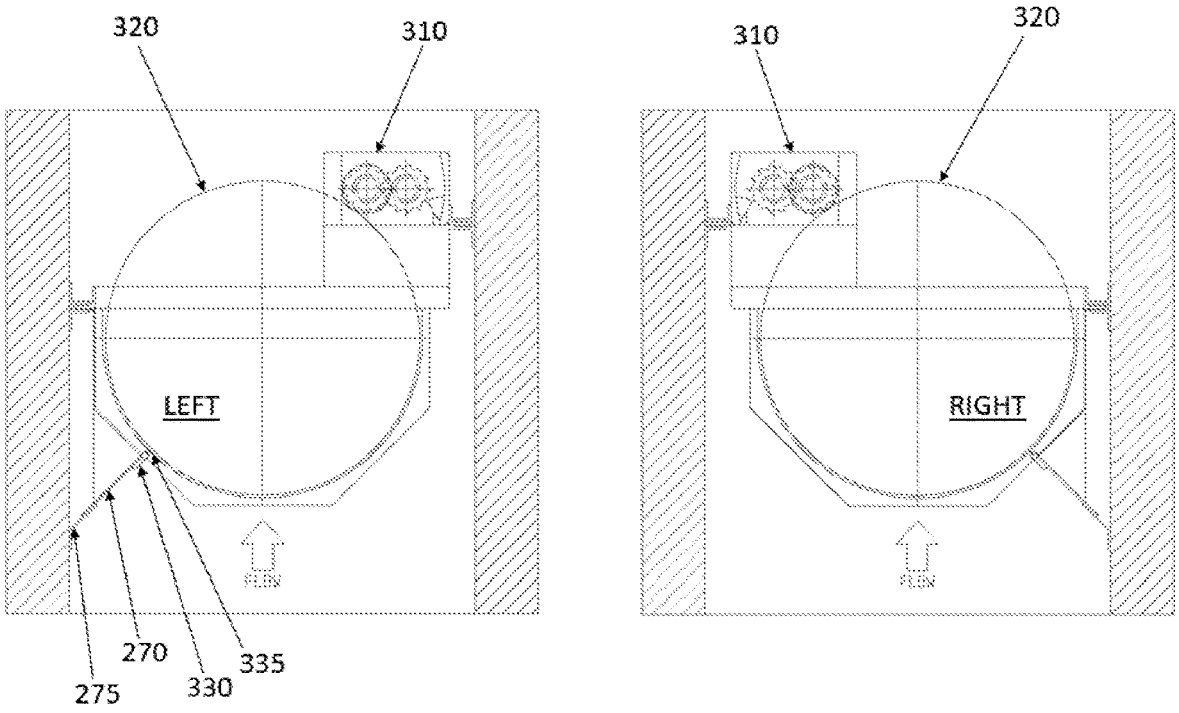
FIG. 5 is a diagram showing left and right placement of the screen drum.
Figure 6:
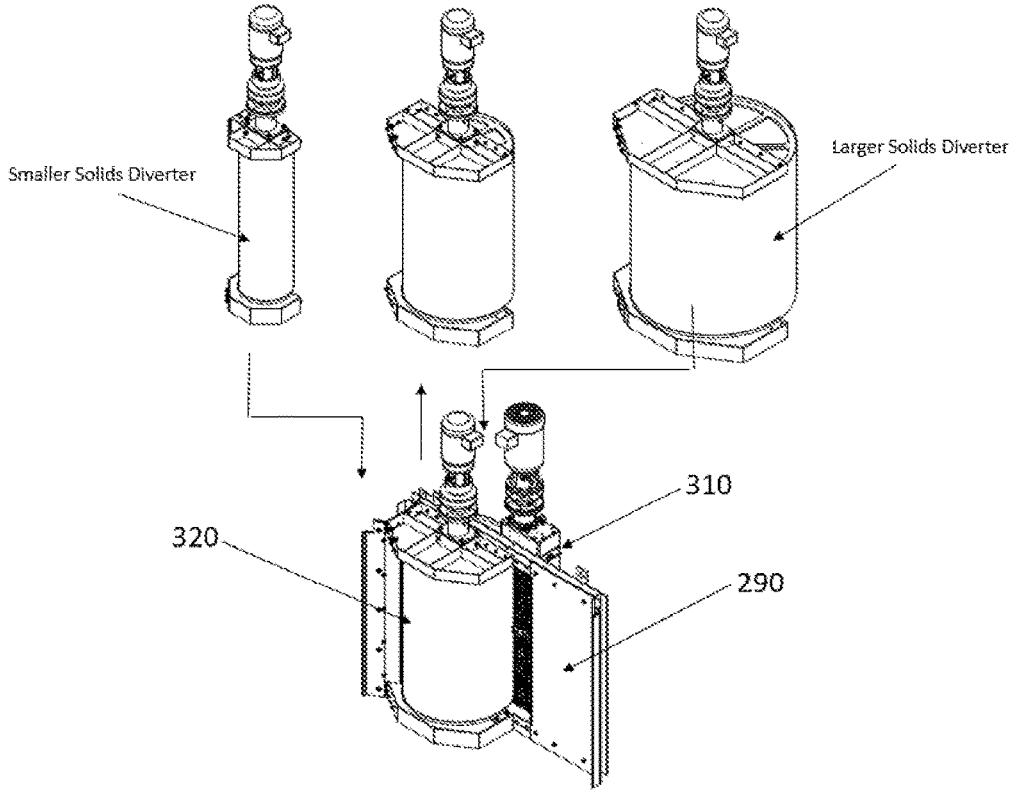
FIG. 6 is an isometric view showing drum module adaptability.
Figure 7:
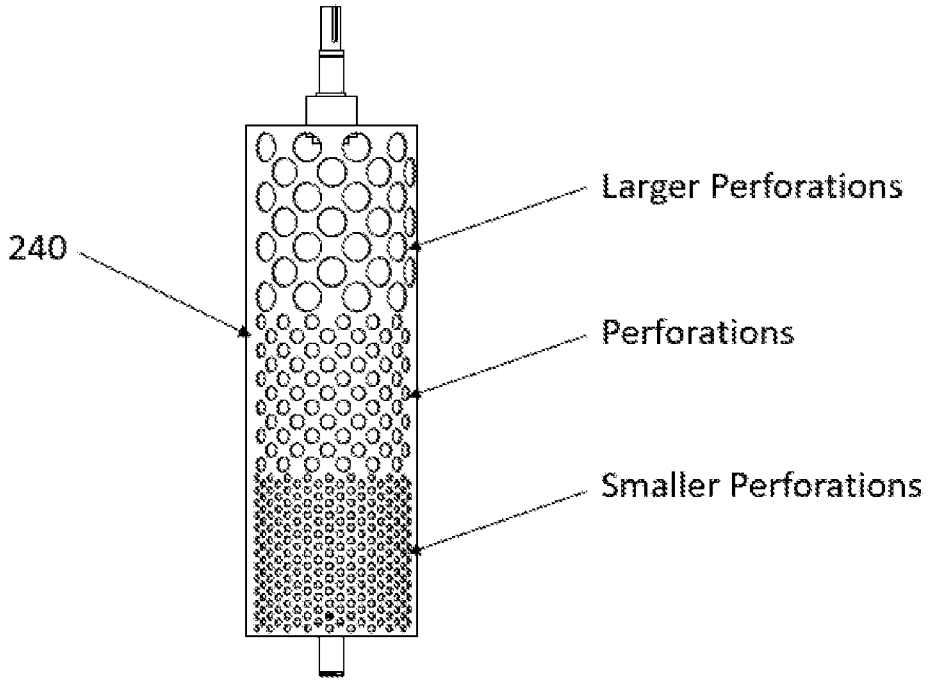
FIG. 7 is a view showing a screen drum with multiple or progressive perforation diameters.
Figure 8:
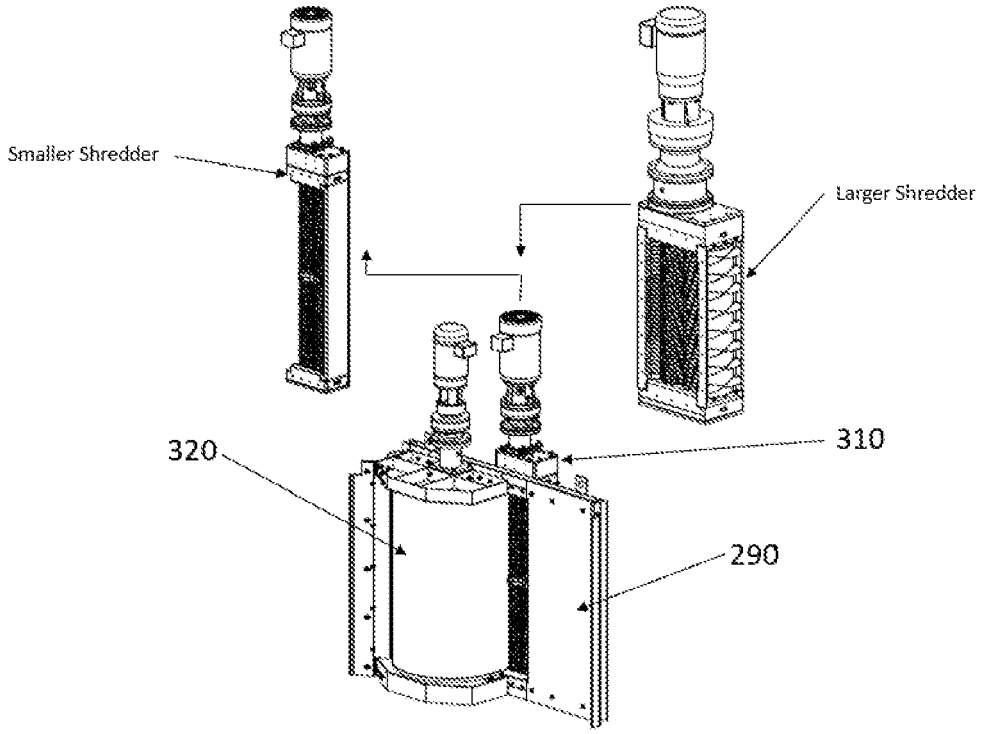
FIG. 8 is an isometric view showing shredder module adaptability.
Figure 9:
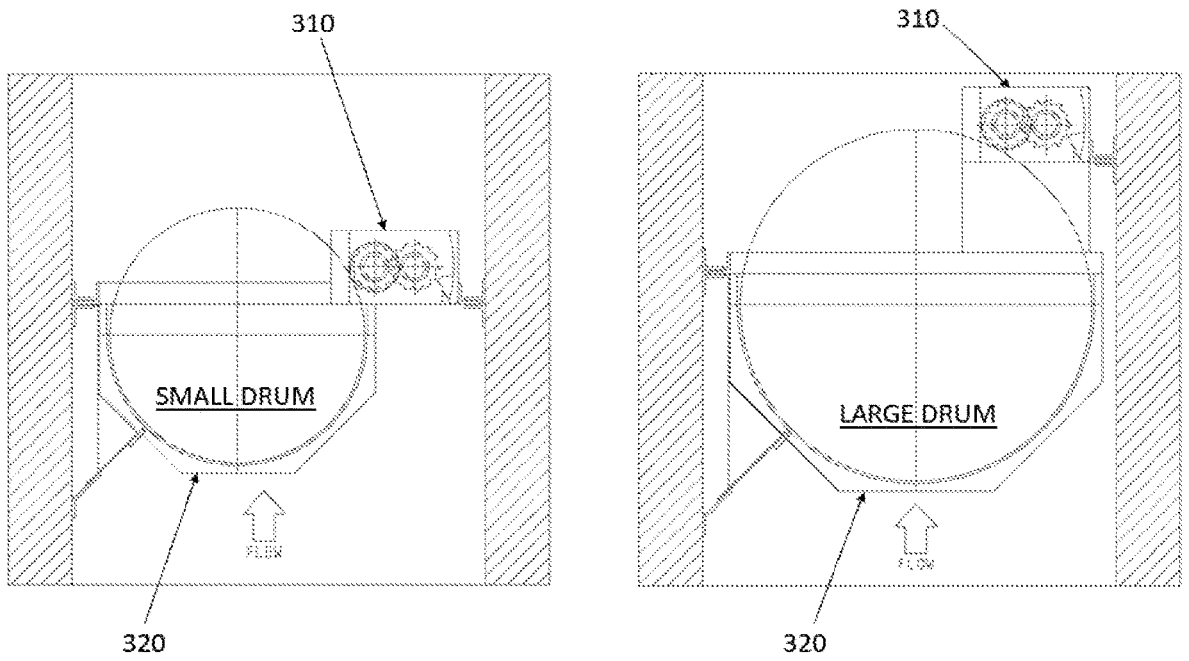
FIG. 9 is a diagram showing placement of the cutter stack relative to the drum.
Figure 10:
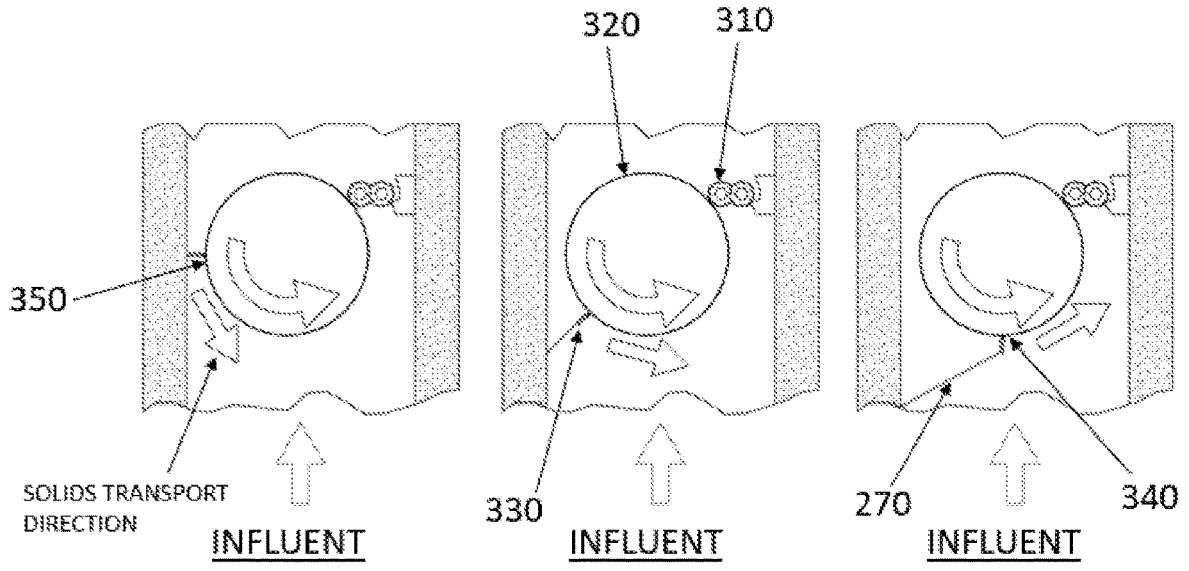
FIG. 10 is shows various embodiments of drum open-area adjustability.

Adjacent to the drive or the driven cutter stack is a vertically-oriented rotating screen drum 240, separated from the cutter stack by a clearance or gap 50. The screen drum may be fashioned from perforated plate of uniform perforation size, or may have perforations of varying sizes 240 (FIG. 7). The top and bottom ends of the screen drum are fitted with stub shafts supported by bearings retained in end housings 250, 260 (FIG. 4). The end housings may be one-piece elements machined from a cast iron or other metal, welded plates and shapes, or other suitable material, or may be hybrid assemblies consisting of dedicated, structural, seal holding elements, as well as shrouds to inhibit flow under or over the ends of the screen drum. To mitigate the effects of liquid ingress to the bearings, shaft seals are fitted between the shafts and end housings on the wet or process side of the bearings. The top and bottom screen drum end housings are enclosed by covers to maintain a dry side to the shaft support bearings. The top shaft protrudes through the cover on the top end housing 250. The protruding end of the shaft is coupled to a rotational drive mechanism 280 that may be electro-mechanical, hydro-mechanical or other. On the side of the screen drum 240 opposite the cutter stack 310, a baffle or side rail 270 is fitted to direct channel flow to the screen drum and inhibit flow around the opposite-cutter stack side of the drum. The vertically-oriented baffle 270 (FIG. 5) is affixed at the top end, and the bottom end, to the top and bottom end housings of the screen drum assembly. Affixed to the edge of the baffle closest to the drum is a sealing element 330 making a vertical, line-contact with the drum to further inhibit the bypass of liquid and solids around the opposite-cutter stack side of the drum. The sealing element is located point 335 on the outer surface of the rotating drum determined to optimize the flow capacity relative to the capture effectiveness of the screen drum module. Affixed to the edge of the baffle opposite the drum seal element is a channel seal 275 fashioned from a material capable of making a reasonable seal to the channel wall or mounting frame. This channel seal further inhibits flow around the opposite-cutter stack side of the rotating screen drum. Together, these elements form what may be called a screen drum module or drum module. In operation, the screen drum rotates in the direction appropriate to transfer or guide material captured on the face of the screen away from the drum seal element and toward the cutter stack.

Figure 11:
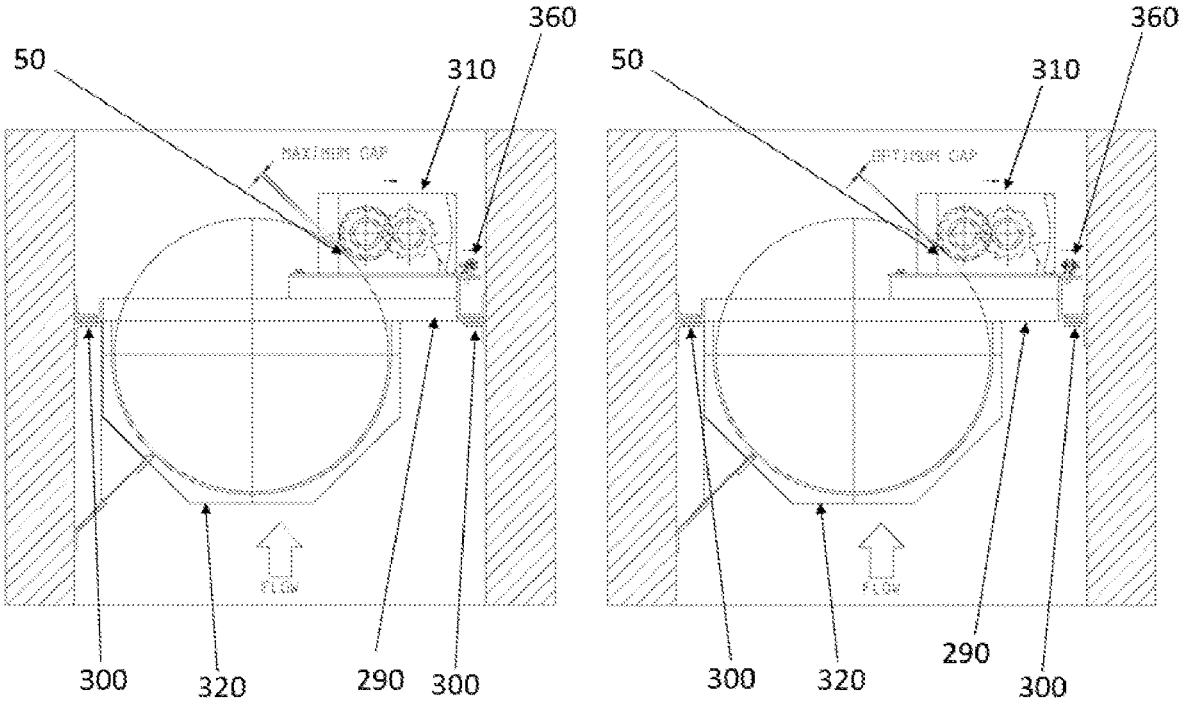
FIG. 11 is a diagram showing variations in the drum/cutter gap.
Figure 12:
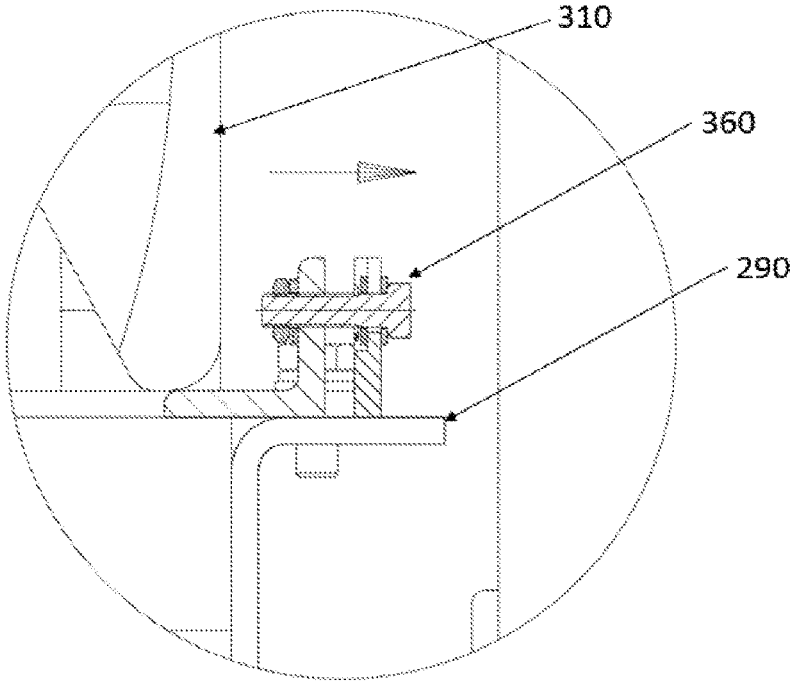
FIG. 12 is a diagram showing an embodiment of the gap adjustment mechanism.
Figure 13:
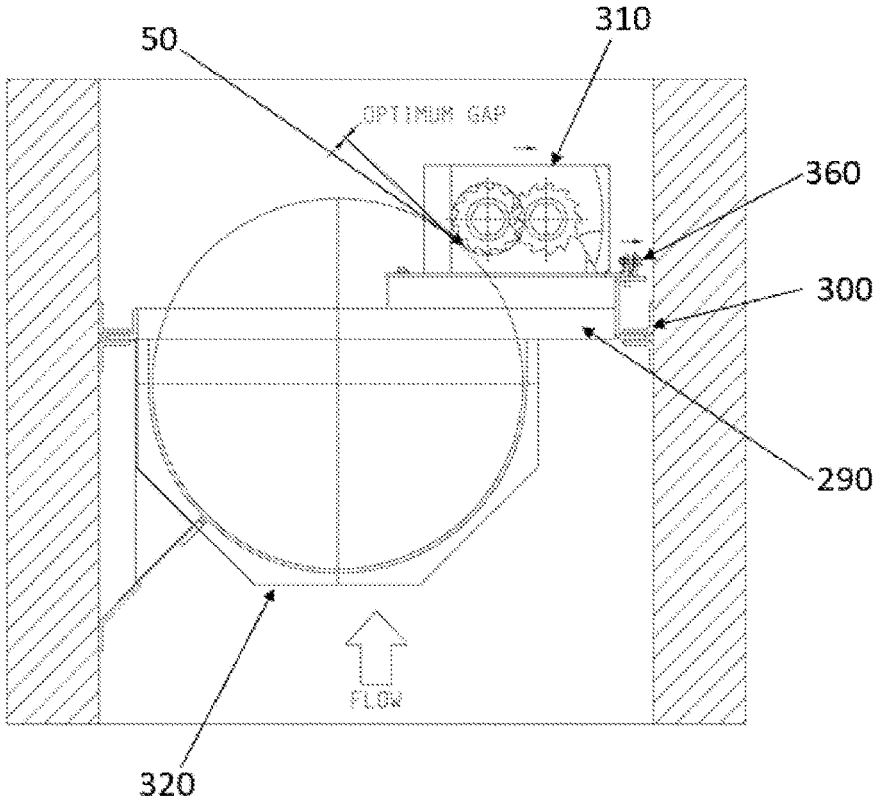
FIG. 13 is a diagram showing outboard adjustment of the drum/cutter gap.
Figure 14:
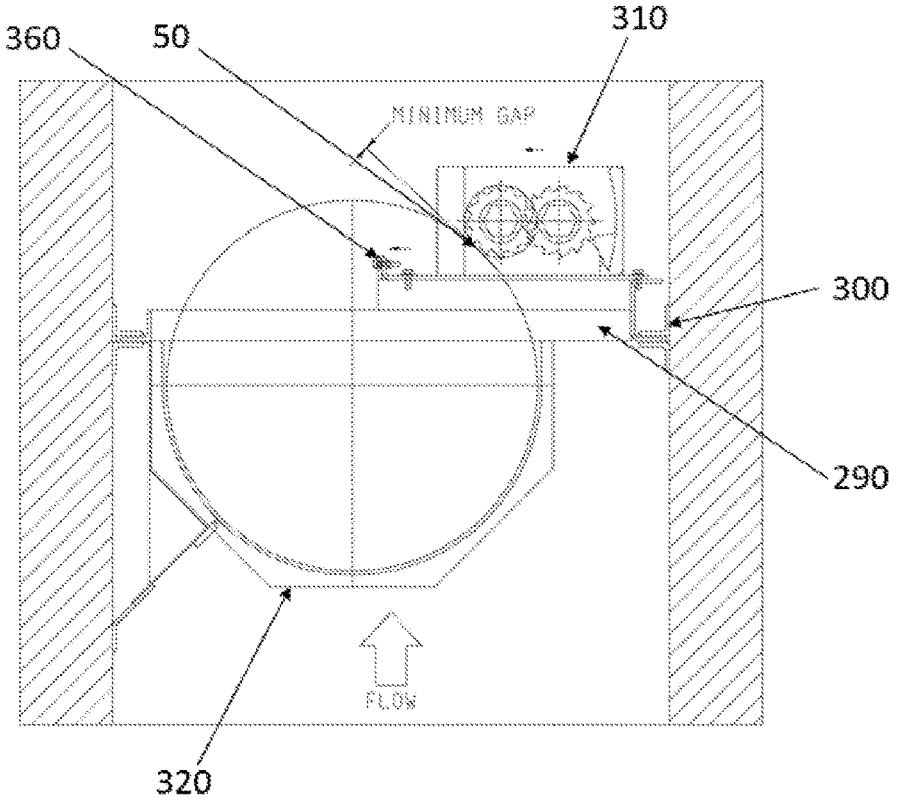
FIG. 14 is a diagram showing inboard adjustment of the drum/cutter gap.

In the preferred embodiment, both the shredder module and screen drum module are affixed to an interconnecting frame or tie frame 290 (FIG. 11). The tie frame is oriented laterally in the channel or mounting frame 300 with the drum module connected to the anterior surface of the tie frame 290 and the shredder module connected to the posterior surface of the frame. While the drum module 320 position is fixed relative the tie frame, the shredder module 310 is connected using an adjustment mechanism 360 allowing manual adjustment of the screen drum/cutter stack gap 50. The adjustment mechanism may be located on the outboard side 360 (FIG. 13) of the grinder nearest channel wall or on the inboard side 360 (FIG. 14) of the grinder nearest the rotating drum. The interconnecting frame 290 is configured to form a seal with the portion of the front face of the shredder 310 opposite the drum 320, and the channel or mounting frame 300, to inhibit flow past the opposite-drum side of the shredder.

Figure 15:
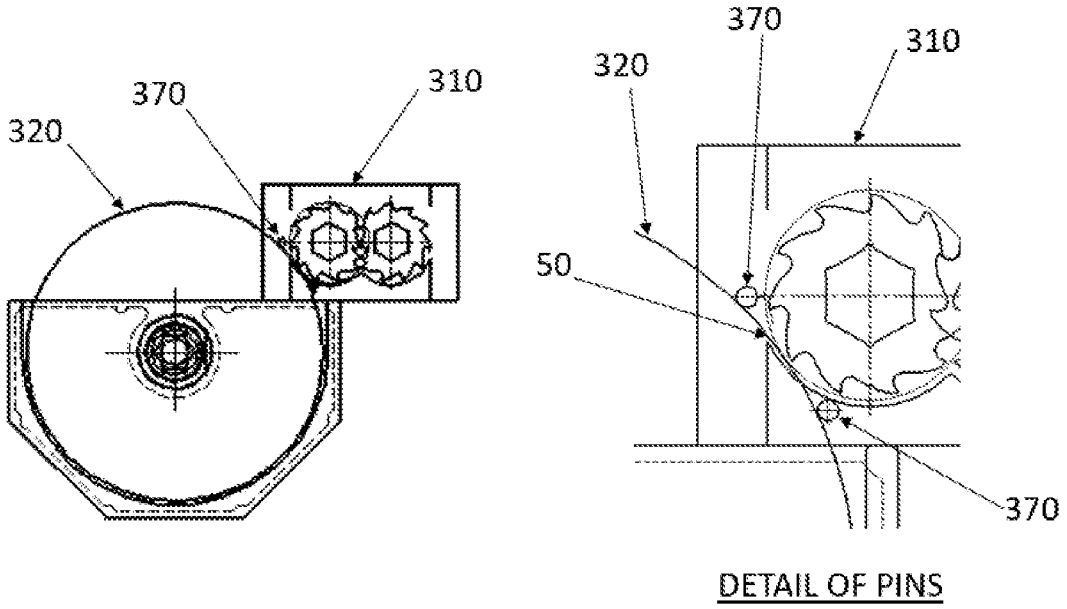
FIG. 15 is a diagram of an embodiment using stops or pins to locate the cutter stack relative to the drum.

In another embodiment, the adjustment mechanism may be comprised of stops or pins 370 (FIG. 15) located on the wetted horizontal surfaces of the shredder module end housings. The locations of the stops are predetermined by the design and act to set the drum/cutter stack gap so as to inhibit the cutters from damaging the rotating screen drum.

Figure 16:
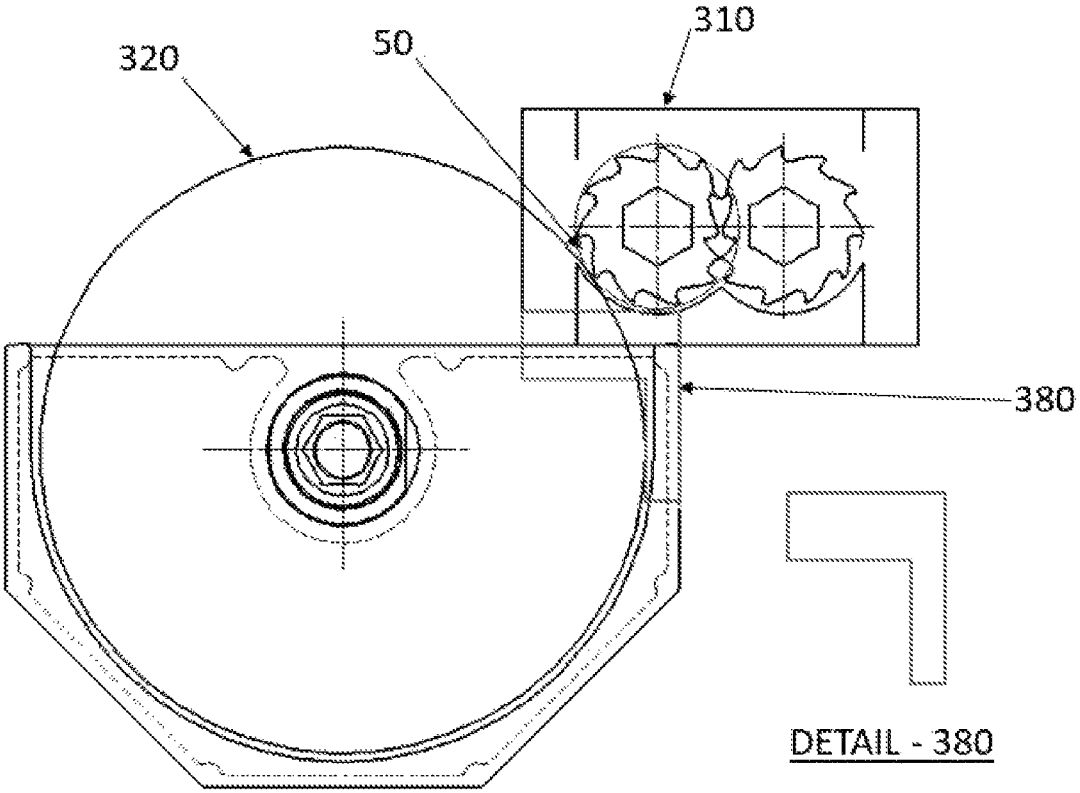
FIG. 16 is a diagram of an embodiment using a key to locate the cutter stack relative to the drum.

In yet another embodiment, the screen drum module and shredder module may be interconnected with locating keys 380 (FIG. 16) affixed to the wetted horizontal surfaces of the drum & shredder module end housings. Each key may be comprised of a rigid, flat plate of suitable, shape, thickness and strength to maintain the relative positions of the drum and shredder modules, while minimizing interference with the flow of liquid and solids through the machine.

What is claimed is:

1. A system for comminuting solid waste material comprising:

a casing defining a comminution chamber having two side walls and being open on opposite sides thereof for permitting the flow of liquid therethrough bearing solid waste material and being adapted for connection in a solid waste disposal line;

a shredding device disposed within the casing and comprising parallel first and second shredding stacks that include first and second parallel shafts rotabably mounted between an upper shredding device housing and a lower shredding device housing, each of the first and second parallel shafts including a plurality of cutting elements mounted such that a plurality of first cutting elements on said first shaft are in an interspaced relationship with a plurality of second cutting elements mounted on said second shaft, each of said cutting elements having at least one cutting tooth thereon, said cutting elements being positioned between and separated in an axial direction by spacers which are coplanar with the cutting elements of an adjacent stack such that a cutting element from one stack and a spacer from an other stack form a pair of interactive shredding members;

a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device; and an adjustable sealing element disposed between a wall of the casing adjacent to the rotating screening drum and the rotating screen drum to form a seal between the rotating screening drum and the wall, wherein the adjustable sealing element is configured to be adjustable in different positions to contact the drum at positions that are closer to a position between an axis of the rotating screening drum and a point on the wall in a direction perpendicular to the flow in the comminution chamber, to a position that is closer to a leading edge of the rotating screening drum, wherein the upper shredding device housing and the lower shredding device housing are separate members from the upper screening drum housing and the lower screening drum housing.

2. The system for comminuting solid waste material according to claim 1, wherein the shredding device and the rotating screening drum are configured to be positioned in the comminution chamber independent of one another.

3. The system for comminuting solid waste material according to claim 1, wherein the shredding device is disposed adjacent to the rotating screening drum and separated by a predetermined minimum gap.

4. The system for comminuting solid waste material according to claim 3, wherein a position of the minimum gap is located within a range from a point adjacent to a rotational axis of the rotating screening drum along a line perpendicular to a direction of flow through the comminution chamber, to a position on the most downstream position of the rotating screening drum.

5. The system for comminuting solid waste material according to claim 1, wherein the rotating screening drum is formed using perforations to permit fluid to flow therethrough, and a size of the perforations vary along the surface of the rotating screening drum along a vertical direction, wherein the perforations are smaller at a bottom of the rotating screening drum than at a top of the rotating screening drum.

6. The system for comminuting solid waste material according to claim 1, wherein a key is disposed between the upper shredding device housing and the upper screening drum housing and a corresponding one of the lower shredding device housing and the lower screening drum housing to control a relative position between the shredding device and the rotating screening drum.

7. A system for comminuting solid waste material comprising:

a casing defining a comminution chamber having two side walls and being open on opposite sides thereof for permitting the flow of liquid therethrough bearing solid waste material and being adapted for connection in a solid waste disposal line;

a shredding device disposed within the casing and comprising parallel first and second shredding stacks that include first and second parallel shafts rotatably mounted between an upper shredding device housing and a lower shredding device housing, each of the first and second parallel shafts including a plurality of cutting elements mounted such that a plurality of first cutting elements on said first shaft are in an interspaced relationship with a plurality of second cutting elements mounted on said second shaft, each of said cutting elements having at least one cutting tooth thereon, said cutting elements being positioned between and separated in an axial direction by spacers which are coplanar with the cutting elements of an adjacent stack such that a cutting element from one stack and a spacer from an other stack form a pair of interactive shredding members;

a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device, wherein the upper shredding device housing and the lower shredding device housing are separate members from the upper screening drum housing and the lower screening drum housing;

an interconnecting frame that connects the shredding device and the rotating screening drum to at least one wall of the two side walls, the interconnecting frame including a surface extending a vertical length of the rotating screening drum and the shredding device and configured to form a seal with a front face of the shredding device to prevent the flow of liquid from passing between the at least one wall of the two side walls and the shredding device.

8. A system for comminuting solid waste material comprising:

a casing defining a comminution chamber having two side walls and being open on opposite sides thereof for permitting the flow of liquid therethrough bearing solid waste material and being adapted for connection in a solid waste disposal line;

a shredding device disposed within the casing and comprising parallel first and second shredding stacks that include first and second parallel shafts rotatably mounted between an upper shredding device housing and a lower shredding device housing, each of the first and second parallel shafts including a plurality of cutting elements mounted such that a plurality of first cutting elements on said first shaft are in an interspaced relationship with a plurality of second cutting elements mounted on said second shaft, each of said cutting elements having at least one cutting tooth thereon, said cutting elements being positioned between and separated in an axial direction by spacers which are coplanar with the cutting elements of an adjacent stack such that a cutting element from one stack and a spacer from an other stack form a pair of interactive shredding members;

a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device; and an interconnecting frame that connects the shredding device and the rotating screening drum to at least one wall of the two side walls, wherein the interconnecting frame includes an adjusting mechanism to adjust the position of the shredding device toward or away from the rotating screening drum, wherein the upper shredding device housing and the lower shredding device housing are separate members from the upper screening drum housing and the lower screening drum housing.

9. The system for comminuting solid waste material according to claim 8, wherein the adjusting mechanism is adjacent one of the wall or the rotating screening drum.

10. The system for comminuting solid waste material according to claim 8, wherein the adjustment mechanism comprises pins or stops to position the shredding device with respect to the rotating screening drum to maintain a predetermined minimum gap between the shredding device and the rotating screening drum.

11. A system for comminuting solid waste material comprising:

a casing defining a comminution chamber and being open on opposite sides thereof for permitting the flow of liquid therethrough bearing solid waste material and being adapted for connection in a solid waste disposal line;

a shredding device disposed within the casing and comprising parallel first and second shredding stacks that include first and second parallel shafts rotatably mounted between an upper shredding device housing and a lower shredding device housing, each of the first and second parallel shafts including a plurality of cutting elements mounted such that a plurality of first cutting elements on said first shaft are in an interspaced relationship with a plurality of second cutting elements mounted on said second shaft, each of said cutting elements having at least one cutting tooth thereon, said cutting elements being positioned between and separated in an axial direction by spacers which are coplanar with the cutting elements of an adjacent stack such that a cutting element from one stack and a spacer from an other stack form a pair of interactive shredding members;

a rotating screening drum disposed within the casing and mounted between an upper screening drum housing and a lower screening drum housing, the rotating screening drum configured to permit fluid to pass therethrough while capturing solids on an outer surface for delivery to shredding device, an upstream portion of the rotating screening drum disposed upstream of an upstream portion of the shredding device, wherein the rotating screening drum is formed using perforations to permit fluid to flow therethrough, and the size of the perforations vary along the surface of the rotating screening drum along a vertical direction, wherein the perforations are smaller at a bottom of the rotating screening drum than at a top of the rotating screening drum.

* * * * *